United States Patent [19]

Bernett et al.

[11] Patent Number: 4,567,704

[45] Date of Patent: Feb. 4, 1986

[54] RESILIENT CERAMIC TILE FLOORING

[75] Inventors: Frank E. Bernett, Yardley, Pa.; David R. Burley, Cranbury, N.J.

[73] Assignee: Tile Council of America, Inc., Princeton, N.J.

[21] Appl. No.: 847,795

[22] Filed: Nov. 2, 1977

Related U.S. Application Data

[63] Continuation of Ser. No. 793,395, May 3, 1977, abandoned, which is a continuation of Ser. No. 515,649, Oct. 17, 1974, abandoned, which is a continuation-in-part of Ser. No. 302,344, Oct. 30, 1972, abandoned.

[51] Int. Cl.[4] ..... E04C 1/28; E04C 2/54; E04F 15/10

[52] U.S. Cl. ..... 52/309.3; 52/387; 52/389; 52/390; 428/49

[58] Field of Search ..... 428/49, 48, 310, 166, 428/137, 311, 77, 325; 52/384, 390, 385, 389, 309.3

[56] References Cited

U.S. PATENT DOCUMENTS

| | | | |
|---|---|---|---|
| 636,200 | 10/1899 | Frink | 52/386 |
| 722,520 | 3/1903 | Lawshe | 52/386 |
| 2,018,711 | 10/1935 | Elmewdorf | 52/390 |
| 3,185,748 | 5/1965 | MacDonald | 52/390 |
| 3,192,567 | 7/1965 | Abernethy | 264/261 |
| 3,239,981 | 3/1966 | Fitzgerald | 264/261 |
| 3,335,048 | 8/1967 | Morian | 52/387 |
| 3,362,119 | 1/1968 | Murphy | 52/309.8 |
| 3,516,894 | 6/1970 | Slosberg | 52/309 |
| 3,579,941 | 5/1971 | Tibbals | 52/384 |
| 3,646,180 | 2/1972 | Winnick | 428/49 |
| 3,666,606 | 5/1972 | Stokes | 52/390 |
| 3,684,630 | 8/1972 | Sensenig | 52/309.8 |

FOREIGN PATENT DOCUMENTS

| | | | |
|---|---|---|---|
| 1055218 | 4/1959 | Fed. Rep. of Germany | 52/390 |

OTHER PUBLICATIONS

*Chemical Engineers' Handbook*, 5th Edition, McGraw-Hill Book Co. (1973) pp. 23-66.

1965 Book of ASTM Standards, vol. 28, "Rubber Carbon Black Gaskets," American Society for Testing & Materials, pp. 527-535.

*Primary Examiner*—John E. Murtagh

*Attorney, Agent, or Firm*—Morgan, Finnegan, Pine, Foley & Lee

[57] ABSTRACT

A composite floor covering comprising a rubbery backing strip or layer in intimate contact with the floor, ceramic tiles placed over the backing layer and flexible grouting between the tiles.

13 Claims, 2 Drawing Figures

RESILIENT CERAMIC TILE FLOORING

Cross-References to Related Applications

This is a continuation of application Ser. No. 793,395 filed May 3, 1977, which in turn is a continuation of application Ser. No. 515,649, filed Oct. 17, 1974, which in turn is a continuation-in-part of application Ser. No. 302,344 filed Oct. 30, 1972, all now abandoned.

FIELD OF THE INVENTION

The present invention relates to floor coverings and, in particular, ceramic tile floor coverings. Specifically, the invention is directed to providing a resilient tile floor covering having general application and particular utility for covering floors having waterproof membranes thereon. Additional applications of the floor covering of the subject invention are found in environments wherein the attenuation of noise is desirable. The superior impact resistance obtained by the floor covering of the present invention offers additional advantages in its use.

BACKGROUND OF THE INVENTION

Description of the Prior Art

It has long been considered desirable to provide a floor covering having the characteristics of durable, hard surfaced ceramic tile and the resilience of softer floor coverings such as asphalt or vinyl floor coverings and carpeting. Until the advance of the subject invention, this combination of properties was unattainable.

In the past, it was found that ceramic tile, when set over a soft or low strength layer of material with conventional Portland Cement, dry-set or epoxy grout, was subject to breaking and chipping under ordinary use. See, for example, the discussion in U.S. Pat. No. 3,319,392 issued to John V. Fitzgerald.

The use of edge-bonded tile sheets having flexible material to bond the tile edge-to-edge is known. However, commercial installation of edge-bonded tile sheets requires setting of the edge-bonded tile sheets in strong non-resilient adhesive layers. Further, rigid support of edge-bonded tile sheets is required to avoid damaging the tile.

Efforts have also been made to provide a satisfactory floor covering for installing tile in thin layers over a waterproof membrane. In the past, tile set on a waterproof membrane tended to crack due to the fact that the membrane, in order to be effective, was required to be soft and flexible. Typically, a floor protected with a waterproof membrane could not be provided with a tile covering unless it was depressed one and one-half to two inches and then provided with a concrete or mortar layer over the flexible membrane. The concrete or mortar provided the rigid support necessary for the ceramic tile.

SUMMARY OF THE INVENTION

The present invention provides a floor covering having a durable, hard tile surface and resilient characteristics. Conventional ceramic tile is adhered to a relatively thick resilient rubbery backing layer. Flexible grout is inserted in the area between tiles and an adhesive may be used to secure the tile to the backing layer.

It is critical that the resilient rubbery backing layer be relatively thick. The particular thickness is to some extent a function of the resiliency of the material of the backing layer, but in all cases the thickness of the layer must be at least greater than 1/32nd of an inch.

DESCRIPTION OF THE DRAWINGS

The invention will be better understood when considered with the following drawings wherein.

DESCRIPTION OF THE PREFERRED EMBODIMENTS

The subject invention is a marked departure from all previous efforts directed to providing a resilient floor covering with the surface characteristics of ceramic tile. In the past, it was believed that very thin layers of resilient backing would facilitate the use of ceramic tile in a resilient floor covering. Generally, the backing was of a thickness of about 1/32nd of an inch and, regardless of the combination of materials used, the ceramic tile invariably broke even when subjected to moderate stress.

The resilient ceramic tile floor of the present invention is particularly useful because it improves the properties of impact resistance, resistance to tile breakage, resiliency and resistance to grout-to-tile bond loss over flooring heretofore known. These properties and how they may be varied for particular uses of the floor covering will be discussed below.

The floor covering of the subject invention has been found successful in practice because an unusually soft resilient layer of backing material of relatively large thickness is used in combination with ceramic tile, adhesive and flexible grout.

Figure 1:
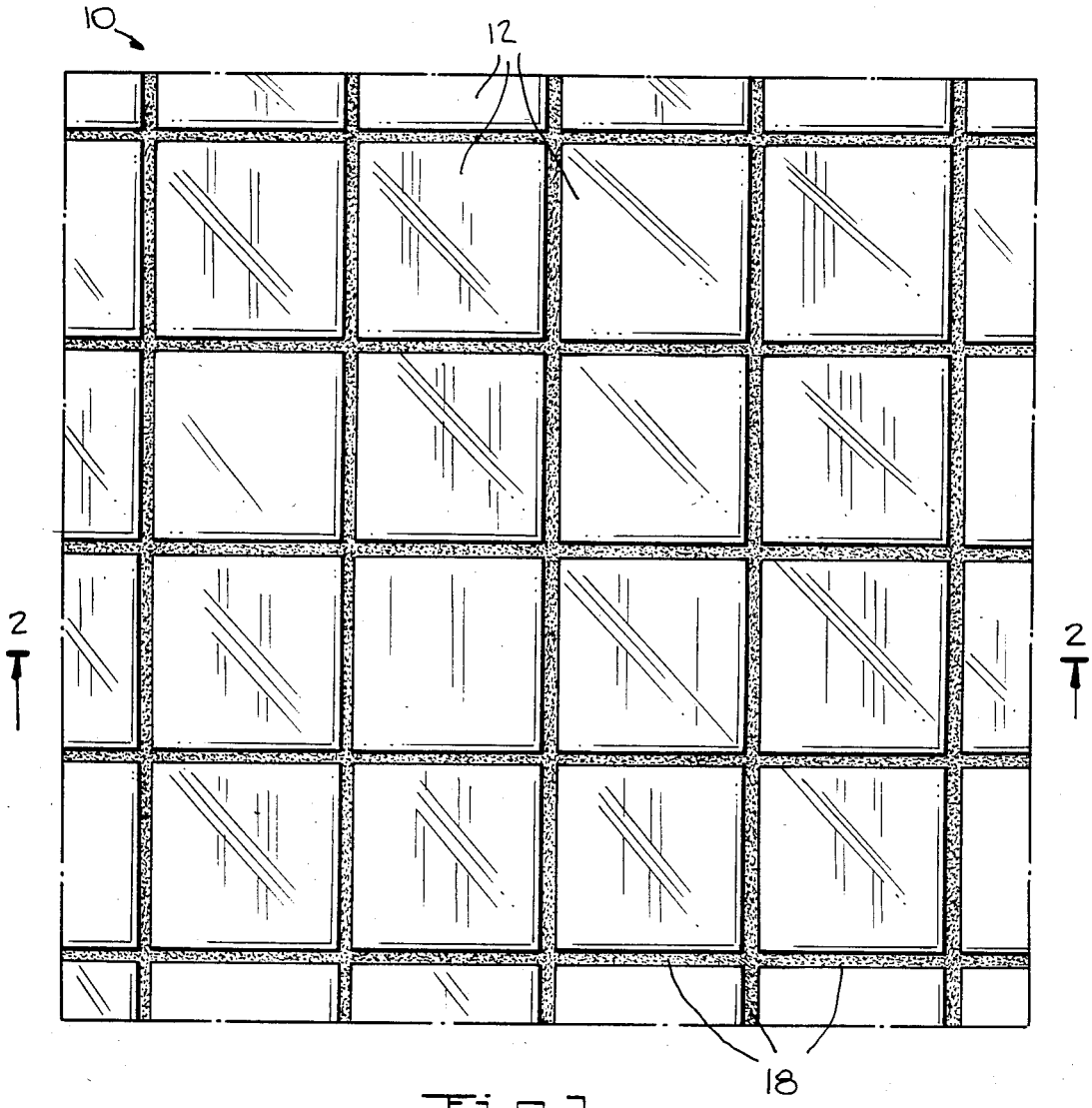
FIG. 1 is a top plan view of the floor covering of the subject invention.
Figure 2:
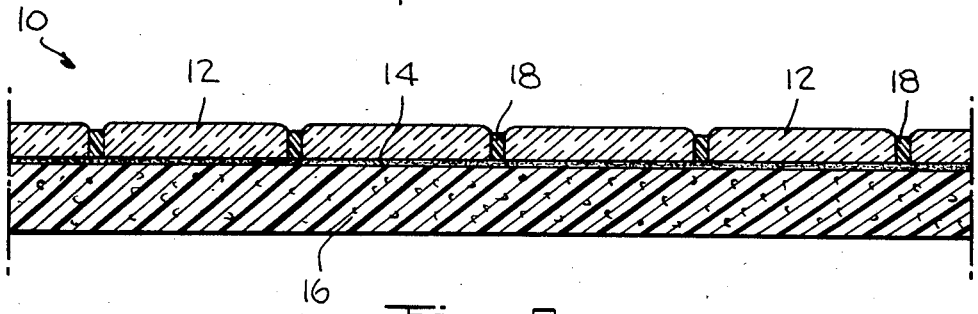
FIG. 2 is a sectional, elevational view taken through line 2—2 of FIG. 1.

The embodiment shown in FIGS. 1 and 2 consists of a floor covering 10 formed of a plurality of ceramic tiles 12 having flexible grout 18 arranged therebetween. In FIG. 2 the relatively thick backing strip 16 of resilient rubbery material is shown supporting the tiles 12 and grouting 18. The tiles 12 are adhered to the backing strip 16 by an adhesive 14.

The flexible backing strip 16 is critical in the present invention. The backing layer 16 must be greater than 1/32nd of an inch and should be between 1/16th of an inch and one inch in thickness. The compression deflection of the backing member 16 should be between 1 psi and 300 psi and preferably between 3 psi and 40 psi as defined in ASTM test method D-1056. In terms of Shore A Durometer measurements, the backing should be between 0 to 70 and preferably between 10 to 40. The exact thickness of the backing member 16 is to some extent a function of the resiliency of the material. For example, increasing the thickness of a firm cushion in a floor makes the floor softer. Additionally, the choice of the floor cushion may also depend upon the size of the tile used.

In practice, it has been found that a flexible cellular material such as a flexible cellular plastic or foamed plastic is most suitable as the backing layer although other materials having comparable resilient properties are contemplated. Open-celled and closed-celled foamed plastics may be used. Closed-celled materials are preferred where the floor covering is subjected to wet surroundings. Of particular utility are the cellular rubbers such as foamed neoprene rubber. Closed-celled foamed neoprene rubber is available in varying densities, illustrative of which are R-421N, R-441N, R-422N, R-423N, R-443N, and R-451N, manufactured by Rubatex Corporation. Other useful flexible cellular plastics inlcude foamed vinyls and urethane foam.

Any ceramic tile is suitable for use as the tile 12. Although ceramic tile is referred to herein, it should be recognized that tiles composed of other brittle materials such as marble, slate and glass would be equally effective in the present invention. Tiles up to a surface dimension of 12 inches by 12 inches are suitable, although individual tile pieces or bits of six inches by six inches and smaller are preferred. There is no restriction on the thickness or shape of the tile pieces or bits or their relative spacing in the floor covering, although the size of the joint between the tiles should be considered when choosing the appropriate grouting material. Generally, the tile pieces or bits may be regularly or irregularly shaped and regularly or irregularly spaced throughout the floor covering.

The tile pieces typically have vertical edge walls extending between the top and bottom horizontal surfaces or faces. Where the edge walls are not substantially vertical, the tiles should be spaced sufficiently from each other so as to form grooves between the tiles sufficient to receive grouting material in the grooves. The grout forms an interlocking lattice of flexible adhesive or bonding agent between and separating each of the tile pieces and bonding adjacent tile pieces at their edges. The flexible grout in the grooves or joints between the tiles enables each of the ceramic tiles to be capable of vertical movement relative to one another. It is often preferable to cause the resilient grouting material to recede into the groove between the tiles to form a concave surface in the bottom of the grooves between the tiles as well as a concave surface between the finished or upper surfaces of the tiles. There are, therefore, no limitations on the thickness of the grout other than that which depends upon the thickness of the ceramic tile pieces. Grouting materials have various physical characteristics including tile-to-bond strength and the choice of the specific grout will often depend upon the thickness and width of the channels, grooves, or joints in which the grout will be filled.

The grout 18 must be relatively flexible and can be any flexible grout. Useful grouts include flexible polymeric elastomers such as natural and synthetic rubbers and polymers of urethane, vinyls, acrylics, epoxies, silicones and various combinations thereof. The grout 18 should also have resiliency characteristics which measure from 6 to 100 and preferably 30 to 80 on a Shore A Durometer. A particularly suitable grout is Vinyl Coating Copolymer-9 of Romany Spartan Tile Company.

The resiliency of the cushion backing as well as the flexibility of the grout and the bond strength of the grout to the tile affects the grout-to-tile bond loss. For a given grout-to-tile strength, a firm floor resists grout-to-tile bond loss better than a soft floor. A reduction in the Shore A hardness of the grout (a softer more elastic grout) can permit a softer floor to have better resistance to grout-to-tile bond loss.

Practice has also taught that CERAMALUX can be used suitably in the subject invention. CERAMALUX is an edge-bonded sheet consisting of tiles 12 with flexible grouting material therebetween. Therefore, it can be seen that in the construction of the floor covering of the present invention, a prefabricated tile panel or sheet consisting of tiles with flexible grout therebetween may be applied directly over the resilient backing. Of course, the assembling of individual tile pieces in edge-to-edge configuration and utilization of conventional grouting and setting techniques directly on the resilient backing layer is equally contemplated. Whether the tiles are in the form of individual pieces or tile panels, they may be either laid dry over the resilient backing or secured to the sub-floor cushion layer by an adhesive means. The adhesive means need not necessarily be applied to the entire back surface of each tile or to all tile. For example, where a tile panel is used, the adhesive means may be applied to the perimeter tiles or lateral edges of the tile panel only.

The adhesive 14, shown in FIG. 2, which secures the tiles 12 to the backing layer 16, may be flexible such as RUBATEX-Adhesive 27780 and organic mastics made for ceramic tile installation, or may be brittle such as epoxy adhesives, for example, Camset-C-150 from Cambridge Tile Mfg. Co. Other adhesives including pressure sensitive adhesives which may be applied to either the tile backing or cushion backing is also contemplated.

A more specific embodiment of the present invention consists of tiles 12 contoured on their lower surface to provide a greater thickness in the center of the tile and a relatively lesser thickness along the tile edges.

EXAMPLE 1

Floor coverings in accordance with the present invention were constructed and subjected to various comparative tests with floor coverings which are outside the scope of the present invention. Table 1, set forth below, describes nine tests wherein nine different floor coverings were tested for various properties which are important to the successful use and durability of floor coverings. Test No. 1 used a floor covering which had no resilient backing layer while test No. 9 had a solid rubber backing. Test Nos. 2–8 utilized floor coverings within the scope of the present invention with cushion backings of varying resiliency and thicknesses as well as grouts of different flexibilities.

Each of these floor coverings were tested using the Robinson-type Floor Tester in accordance with ASTM test method C-627-70 for evaluating ceramic floor tile installing systems. Each of the floor coverings were placed on concrete base slabs and the testing was done using standard test cycles Nos. 5, 6, 10, 12 and 14, in that order.

Among the properties tested include the percentage of grout joints with bond loss after cycle No. 6. The test cycle after which 5% of the tiles in each floor covering were broken was measured and is set forth in Table 1.

The impact resistance of each of the floor coverings is also reported in Table 1. This impact resistance data was obtained using the drop method. An implement weighing 909 grams and having a ½ inch diameter tip for contacting the tile surface was dropped on the tile. For each reported impact resistance, 20 tiles were impacted, each once. The recorded data show the impact level at which 50% of the tiles were damaged. The resilient tile assemblies were mounted on a plywood base for these tests.

Neither of the floors of test Nos. 1 and 9 have the unexpected properties which are shown for the resilient tile floor coverings of test Nos. 2–8. The floor of test No. 9 is not noticeably resilient under foot although it has a solid rubber backing. Additionally, the impact resistance of the floor coverings of test Nos. 1 and 9 have very poor impact resistance in comparison with the floor coverings of the present invention.

The vinyl grout used in test Nos. 4, 5 and 9 has a much lower grout-to-tile strength as compared with the urethane-based grout used in the other tests. As would be expected, and as discussed earlier, the loss of grout in the joints increased as the floor was made softer by incresing the cushion backing thickness. What is surprising, however, is that in test No. 4, where ¼ inch cushion was used, there was a reduction in the breakage of tile and an increase in impact resistance over the floor covering of test No. 5 which had ⅛ inch of the same cushion.

The data relating to bond loss was much better for the tests using the urethane-based grout. Although bond loss again increased as the floor became softer, the increase was less pronounced. Again, the data shows that when the resilient backing was added to the floor covering of test No. 1 there was a considerable decrease in tile breakage and improvement in impact resistance.

TABLE 1

| Test Number | Grout Shore A Durometer | Cushion Data: Material | Cushion Data: Thickness (inch) | Cushion Data: Shore A Durometer | Cushion Data: ASTM D-1056 Compression Deflection P.S.L. | Percent of Group Joints With Bond Loss After Cycle No. 6 | Test Cycle After Which 5% of Tile Are Broken | Impact Resistance (in.-lb.) |
|---|---|---|---|---|---|---|---|---|
| 1 | 70** | None | None | — | — | 0 | 10 | 4 |
| 2 | 70** | R-421N* | ⅛ | 12 | 4 | 2 | 14 | 14 |
| 3 | 70** | Foamed Vinyl | 3/16 | 27 | 15 | 0 | 14 | 28 |
| 4 | 75+ | R-451N* | ¼ | 30 | 20 | 80 | 14 | 35 |
| 5 | 75+ | R-451N* | ⅛ | 30 | 20 | 73 | 12 | 24 |
| 6 | 70** | R-423N* | ¼ | 20 | 10 | 38 | No Damage | 30 |
| 7 | 70** | R-451N* | ¼ | 30 | 20 | 18 | No Damage | 28 |
| 8 | 70** | R-423N* | ⅛ | 20 | 10 | 20 | 14 | 20 |
| 9 | 75+ | Solid Rubber | 3/16 | 80 | 1800 | 0 | 12 | |

*Closed-celled foamed neoprene rubber manufactured by Rubatex Corporation.
**Redi-Set Sheet with urethane-based grout manufactured by American Olean Co.
+Vinyl containing copolymer-9 made by Romany Spartan Tile Company

What is claimed is:

1. A method for improving the resiliency yet maintaining and improving the wearability of a ceramic tile floor covering which comprises ceramic tile arranged in an edge-to-edge, spaced apart relationship, said method comprising the steps of arranging said ceramic tiles in said relationship to overlay but not to be secured directly to a resilient rubbery backing of a flexible foamed or cellular plastic material having a thickness of greater than 1/32nd inch and up to one inch, the resiliency of said backing layer as measured on a Shore A Durometer is between 0 and 40 and wherein the compression deflection of said resilient backing is from 1 to 40 psi as defined in ASTM Test D-1056; and bonding said ceramic tiles to each other along their respective edges with a flexible grouting having resiliency characteristics, said grouting forming an interlocking lattice of flexible adhesive between and separating each of said ceramic tiles and bonding adjacent tile pieces at their edges wherein the top and bottom faces of the ceramic tiles are free of the grouting material and the edges of said tile pieces are substantially vertical.

2. The method of claim 1 wherein the resilient rubbery backing is selected from the group consisting of foamed vinyls and urethane foam.

3. The method of claim 1 wherein the flexible grouting material is a natural or synthetic rubber or polymer selected from the group consisting of polymers of urethanes, vinyls, acrylics, epoxies, silicones and combinations thereof.

4. The method of claim 1 wherein the ceramic tiles are adhered to the backing layer by an adhesive.

5. A method for rendering a floor resilient with a surface covering composed substantially of rigid materials, said method comprising the steps of arranging in an edge-to-edge, spaced apart relationship rigid floor covering pieces selected from the group consisting of ceramic tiles, marble, slate and glass having overall dimensions less than 12"×12";

placing said floor covering pieces in said relationship to overlay but not to be directly secured to a resilient rubbery backing layer composed of open-celled flexible foamed plastic materials, wherein said rubbery backing is greater than 1/32nd inch and up to one inch thickness and has a resiliency as measured on a Shore A Durometer of between 0 and 40 and a compression deflection from 1 to 40 psi as defined in ASTM Test D-1056; and bonding said floor covering pieces to each other along their respective edges with a flexible grouting having resiliency characteristics, said grouting forming an interlocking lattice of flexible adhesive between and separating each of said floor covering pieces and bonding adjacent pieces at their edges wherein the top and bottom faces of the ceramic tiles are free of the grouting material and the edges of said tile pieces are substantially vertical.

6. The method of claim 5 wherein said backing layer is a open-celled foamed neoprene rubber.

7. A floor covering characterized as having a hard tiled surface but having resilient characteristics and capable of withstanding normal floor use, said floor covering comprising a resilient backing of a flexible foamed or cellular material having a thickness of greater than 1/32nd inch and up to one inch, said backing arranged in intimate contact with the floor, the resiliency of said backing layer as measured on a Shore A Durometer is between 10 and 40 and wherein the compression deflection of said resilient backing is from 3 to 40 psi as defined in ASTM Test D-1056;

a plurality of ceramic tiles spaced edge-to-edge to overlay but not to be secured directly to the resilient backing, said tiles being spaced sufficiently from each other so as to form a groove between adjacent tiles; and flexible grouting in the area between the ceramic tiles, said grout having resiliency characteristics and forming an interlocking lattice of flexible material between and separating each of said tiles, bonding adjacent tile pieces at their edges wherein the top and bottom faces of the ceramic pieces are free of the grouting materials and the edges of said tile pieces are substantially vertical.

8. The floor covering as described in claim 7 wherein the ceramic tiles are adhered to the backing layer by an adhesive.

9. The floor covering as described in claim 7 wherein the resilient backing is composed of a closed-celled flexible foamed plastic material.

10. The floor covering as described in claim 7 wherein the backing layer is comprised of a flexible foamed plastic selected from the group consisting of foamed vinyls and urethane foam.

11. The floor covering as described in claim 7 wherein the foamed material is a closed-celled foamed neoprene rubber.

12. The floor covering as described in claim 7 wherein the flexible grouting material is a natural or synthetic rubber or polymer selected from the group consisting of polymers of urethanes, vinyls, acrylics, epoxies, and silicones and combinations thereof.

13. The floor covering as described in claim 7 wherein the grouting material has a resiliency as measured on a Shore A Durometer of from 30 to 80.

* * * * *